US009741288B2

(12) United States Patent
Zhang

(10) Patent No.: US 9,741,288 B2
(45) Date of Patent: Aug. 22, 2017

(54) PIXEL CIRCUIT, ORGANIC ELECTROLUMINESCENT DISPLAY PANEL AND DISPLAY APPARATUS

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventor: Yuting Zhang, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 14/773,491

(22) PCT Filed: Nov. 28, 2014

(86) PCT No.: PCT/CN2014/092565
§ 371 (c)(1),
(2) Date: Sep. 8, 2015

(87) PCT Pub. No.: WO2016/023302
PCT Pub. Date: Feb. 18, 2016

(65) Prior Publication Data

US 2016/0203761 A1 Jul. 14, 2016

(30) Foreign Application Priority Data

Aug. 15, 2014 (CN) ..... 2014 1 0403879

(51) Int. Cl.
*G09G 3/32* (2016.01)
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
None
See application file for complete search history.

(56) References Cited

U.S. PATENT DOCUMENTS 8,026,876 B2 9/2011 Nathan et al.
2009/0225011 A1 9/2009 Choi
(Continued)

FOREIGN PATENT DOCUMENTS

CN 102034426 A 4/2011
CN 102047313 A 5/2011
(Continued)

OTHER PUBLICATIONS

International Search Report and Written Opinion both dated May 20, 2015: Appln. No. PCT/CN2014/092565.
(Continued)

*Primary Examiner* — Joseph Haley
(74) *Attorney, Agent, or Firm* — Ladas & Parry LLP

(57) ABSTRACT

A pixel circuit, an organic electroluminescent display panel and a display apparatus are provided. The pixel circuit comprises: a light-emitting device (D1), a drive control module (1), a reset control module (2), a charge control module (3) and a light-emitting control module (4). The reset control module (2) is used for resetting the light-emitting device (D1) in an internal compensation mode, and exporting a current signal of the drive control module (1) for driving the light-emitting device (D1) and comparing the same with a preset standard current value to determine a compensation factor in an external compensation mode. The charge control module (3) is used for charging and writing a data signal (Data) into the drive control module (1) in the internal compensation mode and writing the data signal (Data) into the drive control module (1) in the external compensation mode. The light-emitting control module (4) is used for charging the drive control module (1) and
(Continued)

controlling the drive control module (1) to drive the light-emitting device (D1) to emit light in the internal compensation mode, and controlling the drive control module (1) to drive the light-emitting device (D1) to emit light in the external compensation mode. Therefore, a same pixel circuit can be shared for both internal compensation and external compensation.

19 Claims, 10 Drawing Sheets

(52) U.S. Cl.
CPC ..... *G09G 2300/0842* (2013.01); *G09G 2300/0852* (2013.01); *G09G 2300/0861* (2013.01); *G09G 2310/0251* (2013.01); *G09G 2310/0262* (2013.01); *G09G 2310/061* (2013.01); *G09G 2320/0233* (2013.01); *G09G 2320/0295* (2013.01); *G09G 2320/0626* (2013.01); *G09G 2330/021* (2013.01)

(56) References Cited

U.S. PATENT DOCUMENTS

2009/0295422 A1 12/2009 Hamer et al.
2014/0306867 A1 10/2014 Qing et al.
2014/0320473 A1 10/2014 Ma
2015/0070252 A1 3/2015 Chen
2015/0213761 A1 7/2015 Chen
2015/0294626 A1* 10/2015 Bi ..... G09G 3/3233 345/211
2016/0005356 A1 1/2016 Zhang
2016/0027379 A1 1/2016 Chen

FOREIGN PATENT DOCUMENTS

CN 103218972 A 7/2013
CN 103247278 A 8/2013
CN 103474025 A 12/2013
CN 103474026 A 12/2013
CN 103474027 A 12/2013
CN 103531151 A 1/2014
CN 104167177 A 11/2014
JP 2009-139823 A 6/2009

OTHER PUBLICATIONS

First Chinese Office Action dated Jan. 4, 2016; Appln. No. 201410403879.4.
Second Chinese Office Action dated May 31, 2016; Appln. No. 201410403879.4.
Third Chinese Office Action dated Nov. 2, 2016; Appln. No. 201410403879.4.

* cited by examiner

PIXEL CIRCUIT, ORGANIC ELECTROLUMINESCENT DISPLAY PANEL AND DISPLAY APPARATUS

TECHNICAL FIELD

The present disclosure relates to a pixel circuit, an organic electroluminescent display panel and a display apparatus.

BACKGROUND

An Organic Light-Emitting Diode (OLED) display is a hot spot in a research field of flat-panel displays at present, and has advantages of low energy consumption, low production cost, self-illumination, wide viewing angle, fast response speed and the like as compared with a Liquid Crystal Display (LCD). At present, OLED has begun to replace a traditional LCD screen in display fields of cellphones, Personal Digital Assistants (PDAs), digital cameras and the like.

Different from the LCD in that brightness is controlled with a stable voltage, the OLED is driven by current, and needs stable current to control light-emitting. Due to a technological process, device aging and so on, a threshold voltage $V_{th}$ of a driving transistor of a pixel circuit has non-uniformity, which results in that the current flowing through each pixel point OLED changes such that the display brightness is non-uniform, thus affecting a display effect of a whole image.

A pixel circuit which can be shared for both internal compensation and external compensation is required.

SUMMARY

At least one embodiment of the disclosure provides a pixel circuit, an organic electroluminescent display panel and a display apparatus, and is intended to provide a pixel unit which can be shared for both internal compensation and external compensation.

At least one embodiment provides a pixel circuit, comprising a light-emitting device, a drive control module, a reset control module, a charge control module and a light-emitting control module.

The reset control module has a control terminal connected with a reset signal terminal, an input terminal connected with a first level signal terminal, and an output terminal connected with an output terminal of the drive control module and an input terminal of the light-emitting device, respectively; the reset control module is used for resetting the light-emitting device in an internal compensation mode, and exporting a current signal of the drive control module for driving the light-emitting device and comparing the same with a preset standard current value to determine a compensation factor in an external compensation mode.

The charge control module has a control terminal connected with a scan signal terminal, an input terminal connected with a data signal terminal, and an output terminal connected with a first input terminal of the drive control module. The charge control module is used for charging the drive control module and writing a data signal into the drive control module in the internal compensation mode, and writing the data signal into the drive control module in the external compensation mode.

The light-emitting control module has a control terminal connected with a light-emitting signal terminal, an input terminal connected with a second level signal terminal, and an output terminal connected with a second input terminal of the drive control module. The light-emitting control module is used for charging the drive control module and controlling the drive control module to drive the light-emitting device to emit light in the internal compensation mode, and controlling the drive control module to drive the light-emitting device to emit light in the external compensation mode;

An output terminal of the light-emitting device is grounded.

In one possible implementation mode, in the pixel circuit provided by at least one embodiment of the disclosure, in the internal compensation mode, at a reset stage, under control of the reset signal terminal, the reset control module is in an ON state, the first level signal terminal is connected with the light-emitting device, and the first level signal terminal resets the light-emitting device; at a charging stage, under control of the scan signal terminal, the charge control module is in an ON state, the data signal terminal is connected with the drive control module, and under control of the light-emitting signal terminal, the light-emitting control module is in an ON state, the second level signal terminal is connected with the drive control module, and the data signal terminal and the second level signal terminal charge the drive control module; at a compensation stage, under control of the scan signal terminal, the data signal terminal writes a data signal into the drive control module; at a light-emitting stage, under control of the light-emitting signal terminal, the second level signal terminal controls the drive control module to drive the light-emitting device to emit light.

In one possible implementation mode, in the pixel circuit provided by at least one embodiment of the disclosure, in the external compensation mode, under control of the scan signal terminal, the data signal terminal writes a data signal into the drive control module; under control of the light-emitting signal terminal, the second level signal terminal controls the drive control module to drive the light-emitting device to emit light; under control of the reset signal terminal, the first level signal terminal exports a current signal of the drive control module for driving the light-emitting device, and the exported current signal is compared with a preset standard current value to determine a compensation factor of the data signal In one possible implementation mode, in the pixel circuit provided by at least one embodiment of the disclosure, the drive control module includes: a driving transistor and a capacitor.

A gate of the driving transistor is connected with the charge control module, a source of the driving transistor is connected with the light-emitting control module, and a drain of the driving transistor is connected with the light-emitting device and the reset control module, respectively. The capacitor is connected between the gate and the drain of the driving transistor.

In one possible implementation mode, in the pixel circuit provided by at least one embodiment of the disclosure, the reset control module includes: a first switching transistor. A gate of the first switching transistor is connected with the reset signal terminal, a source of the first switching transistor is connected with the first level signal terminal, and a drain of the first switching transistor is connected with the drain of the driving transistor and the light-emitting device.

In one possible implementation mode, in the pixel circuit provided by at least one embodiment of the disclosure, the charge control module includes: a second switching transistor. A gate of the second switching transistor is connected with the scan signal terminal, a source of the second switching transistor is connected with the data signal terminal, and a drain of the second switching transistor is connected with the gate of the driving transistor.

In one possible implementation mode, in the pixel circuit provided by at least one embodiment of the disclosure, the light-emitting control module includes: a third switching transistor. A gate of the third switching transistor is connected with the light-emitting signal terminal, a source of the third switching transistor is connected with the second level signal terminal, and a drain of the third switching transistor is connected with the source of the driving transistor.

An embodiment of the disclosure further provides an organic electroluminescent display panel, comprising a plurality of pixel circuits arranged in array, the pixel circuits being the pixel circuits provided by at least one embodiment of the present disclosure.

In one possible implementation mode, the organic electroluminescent display panel provided by at least one embodiment of the disclosure further comprises: reset signal lines and light-emitting signal lines positioned in gaps among respective rows of the pixel circuits at intervals, scan signal lines positioned in gaps among respective rows of pixel circuits having the light-emitting signal lines, and data signal lines positioned in gaps among respective columns of pixel circuits. Respective reset signal lines are connected with reset signal terminals in adjacent rows of respective pixel circuits. Respective light-emitting signal lines are connected with light-emitting signal terminals in adjacent rows of respective pixel circuits.

Two scan signal lines are arranged in the gaps where the respective light-emitting signal lines are positioned, respectively; the two scan signal lines are connected with the scan signal terminals in adjacent rows of respective pixel circuits, respectively; and two adjacent scan signal lines positioned in different gaps, respectively, are electrically connected.

Two data signal lines are arranged in gaps among respective columns of pixel circuits, respectively. The two data signal lines are connected with the data signal terminals of odd-numbered rows or even-numbered rows of pixel circuits in adjacent columns of respective pixel circuits respectively. In the external compensation mode, a data signal is alternatively input to odd-numbered columns of data signal lines and even-numbered columns of data signal lines.

In one possible implementation mode, the organic electroluminescent display panel provided by at least one embodiment of the disclosure further comprises first level signal lines and second level signal lines positioned in gaps among respective columns of pixel circuits. The respective first level signal lines are connected with the first level signal terminals in adjacent columns of respective pixel circuits. The respective second level signal lines are connected with the second level signal terminals in adjacent columns of respective pixel circuits.

In one possible implementation mode, in the organic electroluminescent display panel provided by at least one embodiment of the disclosure, the first level signal lines and the second level signal lines are arranged on a same layer, and are all arranged on a layer different from that of the data signal lines.

In one possible implementation mode, in the organic electroluminescent display panel provided by at least one embodiment of the disclosure, a film layer where the first level signal lines and the second level signal lines are positioned is above a film layer of anodes of the light-emitting devices in the pixel circuits.

At least one embodiment of the disclosure further provides a display apparatus comprising the organic electroluminescent display panel.

At least one embodiment of the disclosure provides the above pixel circuit, the organic electroluminescent display panel and the display apparatus. The pixel circuit comprises a light-emitting device, a drive control module, a reset control module, a charge control module and a light-emitting control module. The reset control module resets the light-emitting device in the internal compensation mode, and exports a current signal of the drive control module for driving the light-emitting device and compares the same with a preset standard current value to determine a compensation factor in the external compensation mode; the charge control module charges and writes a data signal into the drive control module in the internal compensation mode and writes the data signal into the drive control module in the external compensation mode; the light-emitting control module charges the drive control module and controls the drive control module to drive the light-emitting device to emit light in the internal compensation mode, and controls the drive control module to drive the light-emitting device to emit light in the external compensation mode. Therefore, a same pixel circuit can be shared for both internal compensation and external compensation.

DETAILED DESCRIPTION

Figure 1:
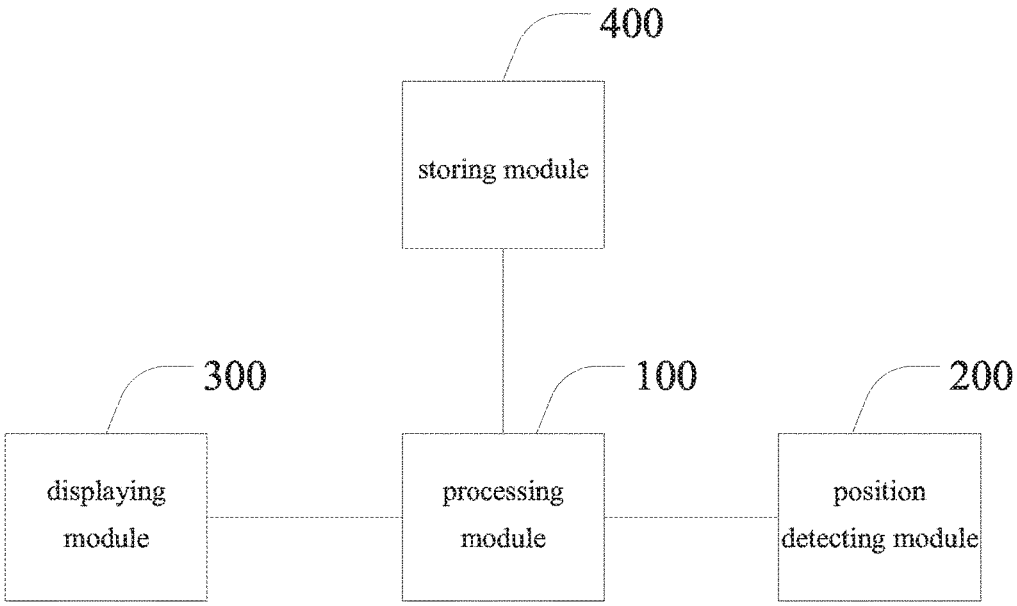
Fig.1 (Related Art)
FIG. 1 is a structural schematic diagram of a known 2T1C pixel circuit.

FIG. 1 is a structural schematic diagram of a known 2T1C pixel circuit. As shown in FIG. 1, the 2T1C pixel circuit consists of one driving transistor T2, one switching transistor T1 and one storage capacitor Cs. When a scan line Scan selects one certain row, a low level signal is input to the scan line Scan, the P-type switching transistor T1 is turned on, and a voltage of a data line Data is written into the storage capacitor Cs; after scanning of the row is finished, the input signal of the scan line Scan turns into a high level, the P-type switching transistor T1 is turned off, a gate voltage stored in the storage capacitor Cs enables the driving transistor T2 to generate current to drive an OLED, ensuring that the OLED consistently emits light in a frame. A saturation current formula of the driving transistor T2 is $I_{OLED}=K(V_{GS}-V_{th})^2$, as described above, due to a technological process and device aging, a threshold voltage $V_{th}$ of the driving transistor T2 is drifted, which results in that the threshold voltage $V_{th}$ of the current flowing through each pixel point OLED changes due to the change of the threshold voltage $V_{th}$ of the driving transistor T2, and non-uniform image brightness is caused.

Figure 2:
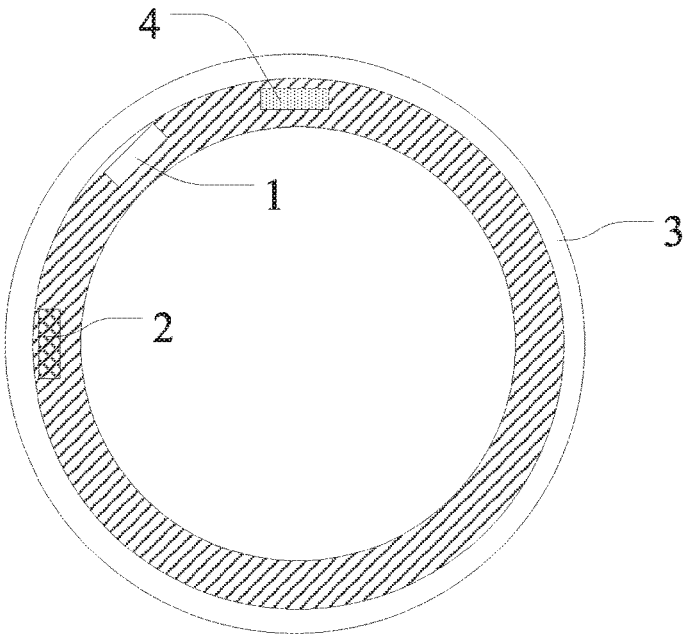
Fig.2 (Related Art)
FIG. 2 is a structural schematic diagram of the known 2T1C pixel circuit which realizes internal compensation.
Figure 3:
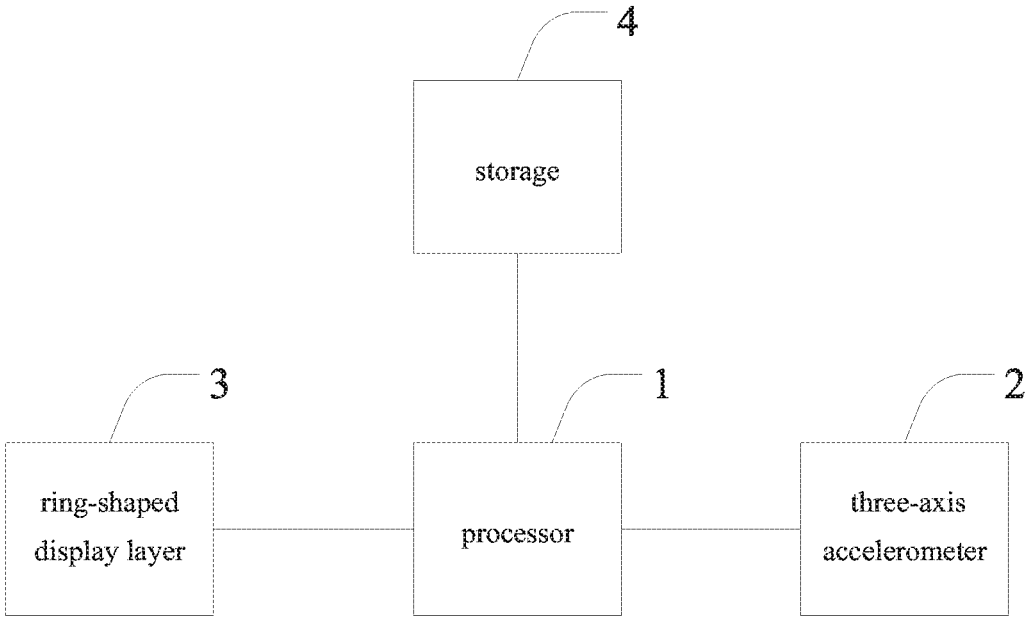
Fig.3 (Related Art)
FIG. 3 is a structural schematic diagram of the known 2T1C pixel circuit which realizes external compensation.

In order to avoid the problem, known solutions are internal compensation (as shown in FIG. 2) and external compensation (as shown in FIG. 3). FIG. 2 is a structural schematic diagram of a known 2T1C pixel circuit which realizes internal compensation. As shown in FIG. 2, one capacitor C2 and two switching transistors T3 and T4 are added in the pixel circuit as shown in FIG. 1, by changing an internal design of the pixel circuit, the current flowing through each pixel point OLED is not affected by the threshold voltage $V_{th}$ of the driving transistor T2, but the pixel circuit as shown in FIG. 2 can only realize internal compensation. FIG. 3 is a structural schematic diagram of the known 2T1C pixel circuit which realizes external compensation. As shown in FIG. 3, a readout circuit 200 is newly added outside the pixel circuit 100 consisting of four sub-pixel circuits as shown in FIG. 1. The readout circuit is used to obtain a compensation factor so as to adjust a driving signal for driving each pixel point OLED to emit light, the current flowing through each pixel point OLED is not changed with the change of the threshold voltage $V_{th}$ of the driving transistor, but the pixel shown in FIG. 3 can only realize external compensation. It can be seen that the pixel circuit in the known OLED can only realize one of the internal compensation and the external compensation, and in order to realize the external compensation, one readout circuit needs to be newly added outside the pixel circuit, which certainly will increase complexity of an OLED structure.

In combination with the drawings, specific implementation modes of the pixel circuit, the organic electroluminescent display panel and the display apparatus provided by embodiments of the disclosure are described in detail.

Figure 4:
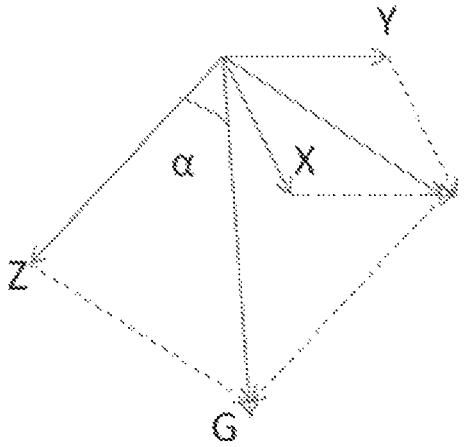
FIG. 4 is a structural schematic diagram of a pixel circuit provided by an embodiment of the disclosure.

FIG. 4 is a structural schematic diagram of a pixel circuit provided by an embodiment of the disclosure. As shown in FIG. 4, the pixel circuit comprises a light-emitting device D1, a drive control module 1, a reset control module 2, a charge control module 3 and a light-emitting control module 4.

The reset control module 2 has a control terminal 2*a* connected with a reset signal terminal RST, an input terminal 2*b* connected with a first level signal terminal Ref1, and an output terminal 2*c* connected with an output terminal 1*c* of the drive control module 1 and an input terminal D1*a* of the light-emitting device D1, respectively. The reset control module 2 is used for resetting the light-emitting device D1 in an internal compensation mode, and exporting a current signal of the drive control module 1 for driving the light-emitting device D1 and comparing the same with a preset standard current value to determine a compensation factor in an external compensation mode.

The charge control module 3 has a control terminal 3*a* connected with a scan signal terminal Scan, an input terminal 3*b* connected with a data signal terminal Data, and an output terminal 3*c* connected with a first input terminal 1*a* of the drive control module 1. The charge control module 3 is used for charging the driving control module 1 and writing a data signal into the driving control module 1 in the internal compensation mode, and writing the data signal into the drive control module 1 in the external compensation mode.

The light-emitting control module 4 has a control terminal 4*a* connected with a light-emitting signal terminal EM, an input terminal 4*b* connected with a second level signal terminal Ref2, and an output terminal 4*c* connected with a second input terminal 1*b* of the drive control module 1. The light-emitting control module 4 is used for charging the drive control module 1 and controlling the drive control module 1 to drive the light-emitting device D1 to emit light in the internal compensation mode and controlling the drive control module 1 to drive the light-emitting device D1 to emit light in the external compensation mode;

An output terminal D1*b* of the light-emitting device D1 is grounded.

The pixel circuit provided by the embodiment of the disclosure comprises a light-emitting device, a drive control module, a reset control module, a charge control module and a light-emitting control module. The reset control module resets the light-emitting device in the internal compensation mode, and exports a current signal of the drive control module for driving the light-emitting device and compares the same with a preset standard current value to determine a compensation factor in the external compensation mode; the charge control module charges the drive control module and writes the data signal into the drive control module in the internal compensation mode, and writes the data signal into the drive control module in the external compensation mode; the light-emitting control module charges the drive control module and controls the drive control module to drive the light-emitting device to emit light in the internal compensation mode, and controls the drive control module to drive the light-emitting device to emit light in the external compensation mode. Therefore, a same pixel circuit can be shared for both internal compensation and external compensation.

During implementation, according to the pixel circuit provided by the embodiment of the disclosure, in the internal compensation mode, at a reset stage, under control of the reset signal terminal RST, the reset control module 2 is in an ON state, the first level signal terminal Ref1 is connected with the light-emitting device DE and the first level signal terminal Ref1 resets the light-emitting device D1; at a charging stage, under control of the scan signal terminal Scan, the charge control module 3 is in an ON state, the data signal terminal Data is connected with the drive control module 1, and under control of the light-emitting signal terminal EM, the light-emitting control module 4 is in an ON state, the second level signal terminal Ref2 is connected with the drive control module 1, and the data signal terminal Data and the second level signal terminal Ref2 charge the drive control module 1; at a compensation stage, under control of the scan signal terminal Scan, the data signal terminal Data writes a data signal into the drive control module 1; at a light-emitting stage, under control of the light-emitting signal terminal EM, the second level signal terminal Ref2 controls the drive control module 1 to drive the light-emitting device D1 to emit light.

During implementation, according to the pixel circuit provided by the embodiment of the disclosure, in the external compensation mode, under control of the scan signal terminal Scan, the data signal terminal Data writes a data signal into the drive control module 1; under control of the light-emitting signal terminal EM, the second level signal terminal Ref2 controls the drive control module 1 to drive the light-emitting device D1 to emit light; under control of the reset signal terminal RST, the first level signal terminal Ref1 exports a current signal of the drive control module 1 for driving the light-emitting device D1, and the exported current signal is compared with a preset standard current value to determine a compensation factor of the data signal.

During implementation, the drive control module 1 in the pixel circuit provided by the embodiment of the disclosure, as shown in FIG. 4, for example, includes: a driving transistor DTFT and a capacitor C. A gate of the driving transistor DTFT is connected with the charge control module 3, a source of the driving transistor DTFT is connected with the light-emitting control module 4, and a drain of the driving transistor DTFT is connected with the light-emitting device D1 and the reset control module 2, respectively; the capacitor C is connected between the gate and the drain of the driving transistor DTFT.

During implementation, the light-emitting device D1 in the pixel circuit provided by the embodiment of the disclosure is an Organic Light-Emitting Diode (OLED) generally. The light-emitting device D1 realizes light-emitting display under action of a saturation current of the driving transistor DTFT. The driving transistor DTFT for driving the light-emitting device D1 to emit light is an N-type transistor or a P-type transistor, which is not defined herein.

During implementation, in the pixel circuit provided by the embodiment of the disclosure, in the internal compensation mode, a voltage of the first level signal terminal Ref1 is a negative voltage or 0, and a voltage of the second level signal terminal Ref2 is a positive voltage generally. Hereinafter, it is described by taking an example that the voltage of the first level signal terminal Ref1 is 0 and the voltage of the second level signal terminal Ref2 is a positive value, in the internal compensation mode.

During implementation, the reset control module 2 in the pixel circuit provided by the embodiment of the disclosure, as shown in FIG. 4, for example, includes: a first switching transistor T1. A gate of the first switching transistor T1 is connected with the reset signal terminal RST, a source of the first switching transistor T1 is connected with the first level signal terminal Ref1, and a drain of the first switching transistor T1 is connected with the drain of the driving transistor DTFT and the light-emitting device D1.

During implementation, the first switching transistor T1 can be an N-type transistor or a P-type transistor, which is not defined herein. When the first switching transistor T1 is an N-type transistor, and when a signal of the reset signal terminal RST is at a high level, the first switching transistor T1 is in an ON state; when the first switching transistor T1 is a P-type transistor, and when a signal of the reset signal terminal RST is at a low level, the first switching transistor T1 is in an ON state.

When the reset control module 2 in the pixel circuit provided by the embodiment of the disclosure, for example, adopts the above first switching transistor T1 as a specific structure, a working principle is as follows: in the internal compensation mode, at the reset stage, the first switching transistor T1 is turned on under control of the reset signal terminal RST, the first level signal terminal Ref1 is connected with the light-emitting device D1, and the first level signal terminal Ref1 resets the light-emitting device D1, to make a potential of the light-emitting device D1 be 0; at a charging stage, a compensation stage and a light-emitting stage, the first switching transistor T1 is turned off. In the external compensation mode, under control of the reset signal terminal RST, the first switching transistor T1 is turned on, the first level signal terminal Ref1 exports a current signal of the driving transistor DTFT for driving the light-emitting device D1, and the exported current signal is compared with a preset standard current value to determine a compensation factor of the data signal.

During implementation, as shown in FIG. 4, the charge control module 3 in the pixel circuit provided by the embodiment of the disclosure, for example, includes: a second switching transistor T2. A gate of the second switching transistor T2 is connected with the scan signal terminal Scan, a source of the second switching transistor T2 is connected with the data signal terminal Data, and a drain of the second switching transistor T2 is connected with the gate of the driving transistor DTFT.

During implementation, the second switching transistor T2 can be an N-type transistor or a P-type transistor, which is not defined herein. In a case that the second switching transistor T2 is an N-type transistor, when a signal of the scan signal terminal Scan is at a high level, the second switching transistor T2 is in an ON state; in a case that the second switching transistor T2 is a P-type transistor, and when a signal of the scan signal terminal Scan is at a low level, the second switching transistor T2 is in an ON state.

When the charge control module 3 in the pixel circuit provided by the embodiment of the disclosure, for example, adopts the above second switching transistor T2 as a specific structure, a working principle is as follows: in the internal compensation mode, at the reset stage, the second switching transistor T2 is turned off; at the charging stage, under control of the scan signal terminal Scan, the second switching transistor is turned on, the data signal terminal Data is connected with the gate of the driving transistor DTFT, the data signal terminal Data charges the gate of the driving transistor DTFT, and writes in a reference signal $V_0$; the light-emitting control module 4 is in an ON state under control of the light-emitting signal terminal EM, the second level signal terminal Ref2 is connected with the source of the driving transistor DTFT, and the second level signal terminal Ref2 charges the drain of the driving transistor DTFT through the source of the driving transistor DTFT till a potential of the drain of the driving transistor is $V_{ref2}-V_{th}$; at the compensation stage, under control of the scan signal terminal Scan, the second switching transistor T2 is turned on, the data signal terminal Data writes a data signal $V_{data}$ into the gate of the driving transistor DTFT; meanwhile, the potential of the gate of the driving transistor DTFT changes from $V_0$ to $V_{data}$, namely, jumps to be same as a potential of the data signal terminal Data; according to a capacitive power conservation principle, the potential of the drain of the driving transistor DTFT correspondingly jumps to $V_{ref2}-V_{th}+V_{data}-V_0$; at the light-emitting stage, the second switching transistor T2 is turned off. In the external compensation mode, under control of the scan signal terminal Scan, the second switching transistor T2 is turned on, and the data signal terminal Data writes the data signal $V_{data}$ into the gate of the driving transistor DTFT.

During implementation, the light-emitting control module 4 in the pixel circuit provided by the embodiment of the disclosure, as shown in FIG. 4, for example, includes: a third switching transistor T3. A gate of the third switching transistor T3 is connected with the light-emitting signal terminal EM, a source of the third switching transistor T3 is connected with the second level signal terminal Ref2, and a drain of the third switching transistor T3 is connected with the source of the driving transistor DTFT.

During implementation, the third switching transistor T3 can be an N-type transistor or a P-type transistor, which is not defined herein. In a case that the third switching transistor T3 is an N-type transistor, when a signal of the light-emitting signal terminal EM is at a high level, the third switching transistor T3 is in an ON state; in a case that the third switching transistor T3 is a P-type transistor, when a signal of the light-emitting signal terminal EM is at a low level, the third switching transistor T3 is in an ON state.

When the light-emitting control module 4 in the pixel circuit provided by the embodiment of the disclosure, for example, adopts the above third switching transistor T3 as a specific structure, a working principle thereof is as follows: in the internal compensation mode, at the reset stage, the third switching transistor T3 is turned off; at the charging stage, under control of the light-emitting signal terminal EM, the third switching transistor T3 is in an ON state, the second level signal terminal Ref2 is connected with the source of the driving transistor DTFT, the second level signal terminal Ref2 charges the drain of the driving transistor DTFT through the source of the driving transistor DTFT till the potential of the drain of the driving transistor is $V_{ref2}-V_{th}$; at the compensation stage, the third switching transistor T3 is turned off, the second switching transistor T2 is turned on under control of the scan signal terminal Scan, the data signal terminal Data writes the data signal $V_{data}$ into the gate of the driving transistor DTFT, the potential of the gate of the driving transistor DTFT changes from $V_0$ to $V_{data}$ accordingly, namely, jumps to be same as a potential of the data signal terminal Data, and the potential of the drain of the driving transistor DTFT correspondingly jumps to $V_{ref2}-V_{th}+V_{data}-V_0$ according to a capacitive power conservation principle; at the light-emitting stage, the third switching transistor T3 is in an ON state under control of the light-emitting signal terminal EM, after a current signal of the second level signal terminal Ref2 flows to the driving transistor DTFT through the third switching transistor T3, the light-emitting device D1 is driven to emit light, wherein, it can be derived by a saturation current formula of the driving transistor DTFT that a working current flowing into the light-emitting device D1 is $$I_{OLED}=K(V_{gs}-V_{th})^2=k\alpha[V_{ref2}-(V_{ref2}-V_{th}+V_{data}-V_0)-V_{th}]^2=k\alpha(V_0-V_{data})^2$$

Where, K is a current constant associated with the driving transistor DTFT; $V_{gs}$ is a voltage of the gate of the driving transistor DTFT relative to the source of the driving transistor DTFT, and $V_{th}$ is a threshold voltage of the driving transistor DTFT. Parameters in following embodiments have the same meanings.

It can seen that the working current $I_{OLED}$ of the light-emitting device is not affected by the threshold voltage $V_{th}$ of the driving transistor and is only related to the data signal voltage $V_{data}$ input from the data signal terminal and the reference signal voltage $V_0$, drift of the threshold voltage $V_{th}$ of the driving transistor DTFT caused by a technical process and device aging is thoroughly avoided, so as not to affect the working current $I_{OLED}$ of the light-emitting device D1, and ensure normal work of the light-emitting device D1. In the external compensation mode, under control of the light-emitting signal terminal EM, the third switching transistor T3 is turned on, and the second level signal terminal Ref2 controls the driving transistor DTFT to drive the light-emitting device D1 to emit light.

It needs to be explained that the driving transistor and the switching transistors mentioned in the embodiments of the disclosure can be Thin Film Transistors (TFTs), or can be Metal Oxide Semiconductor (MOS) field-effect transistors, which are not defined herein. In implementation, sources and drains of these transistors are interchangeable, and are not differentiated. When the embodiments are described, a case that both the driving transistor and the switching transistors are TFTs is taken as an example.

Figure 5:
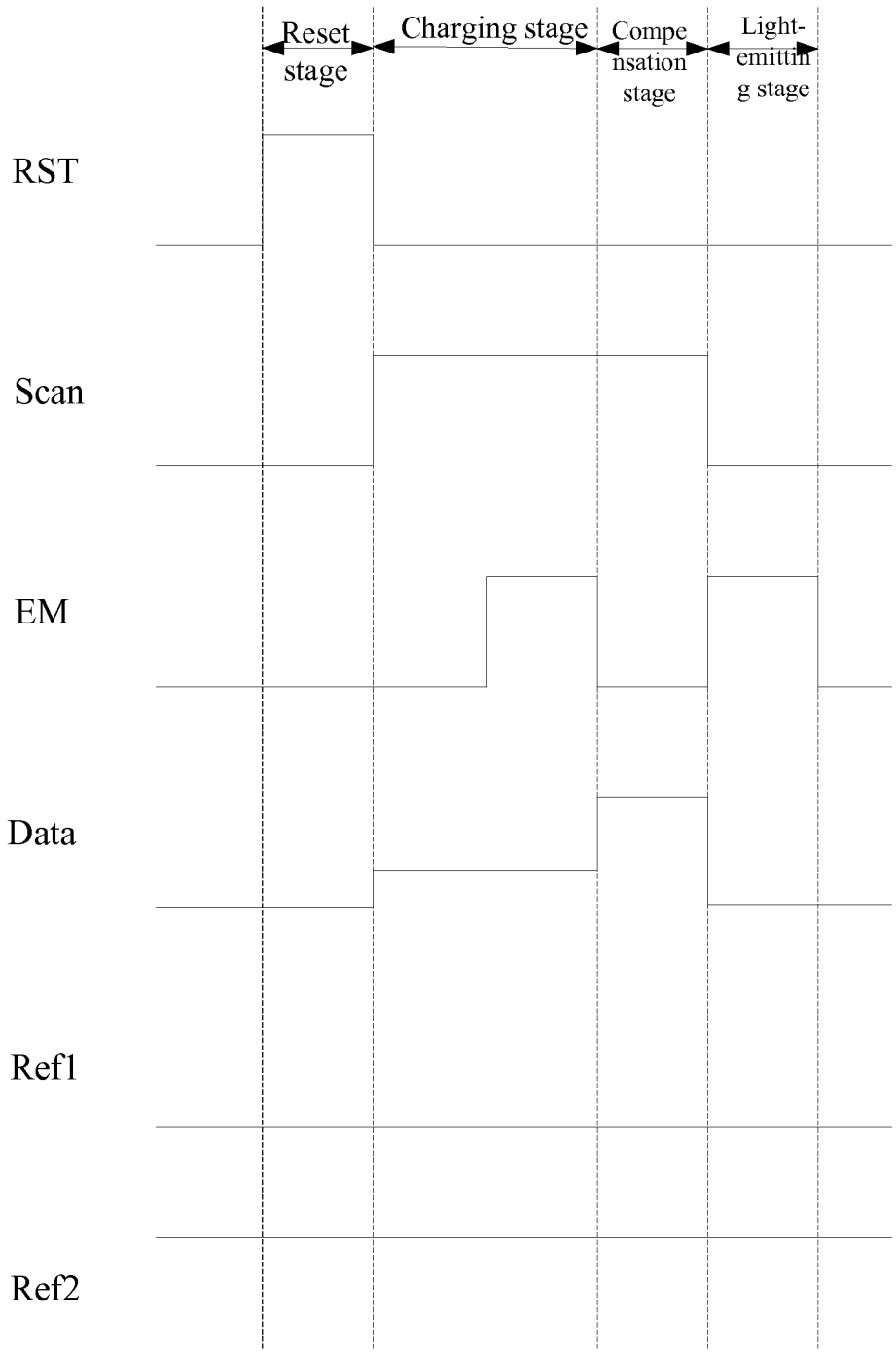
FIG. 5 is a circuit timing diagram of the pixel circuit provided by the embodiment of the disclosure.

Hereinafter, a case that the driving transistor and the switching transistors in the pixel circuit are all N-type transistors is taken as an example to describe a working principle of the pixel circuit in the external compensation mode and the internal compensation mode. FIG. 5 is a circuit timing diagram corresponding to the pixel circuit as shown in FIG. 4. FIG. 6-FIG. 10 are schematic diagrams of the pixel circuit provided by the embodiment of the disclosure at a reset stage, a charging stage, a compensation stage and a light-emitting stage, respectively.

Figure 6:
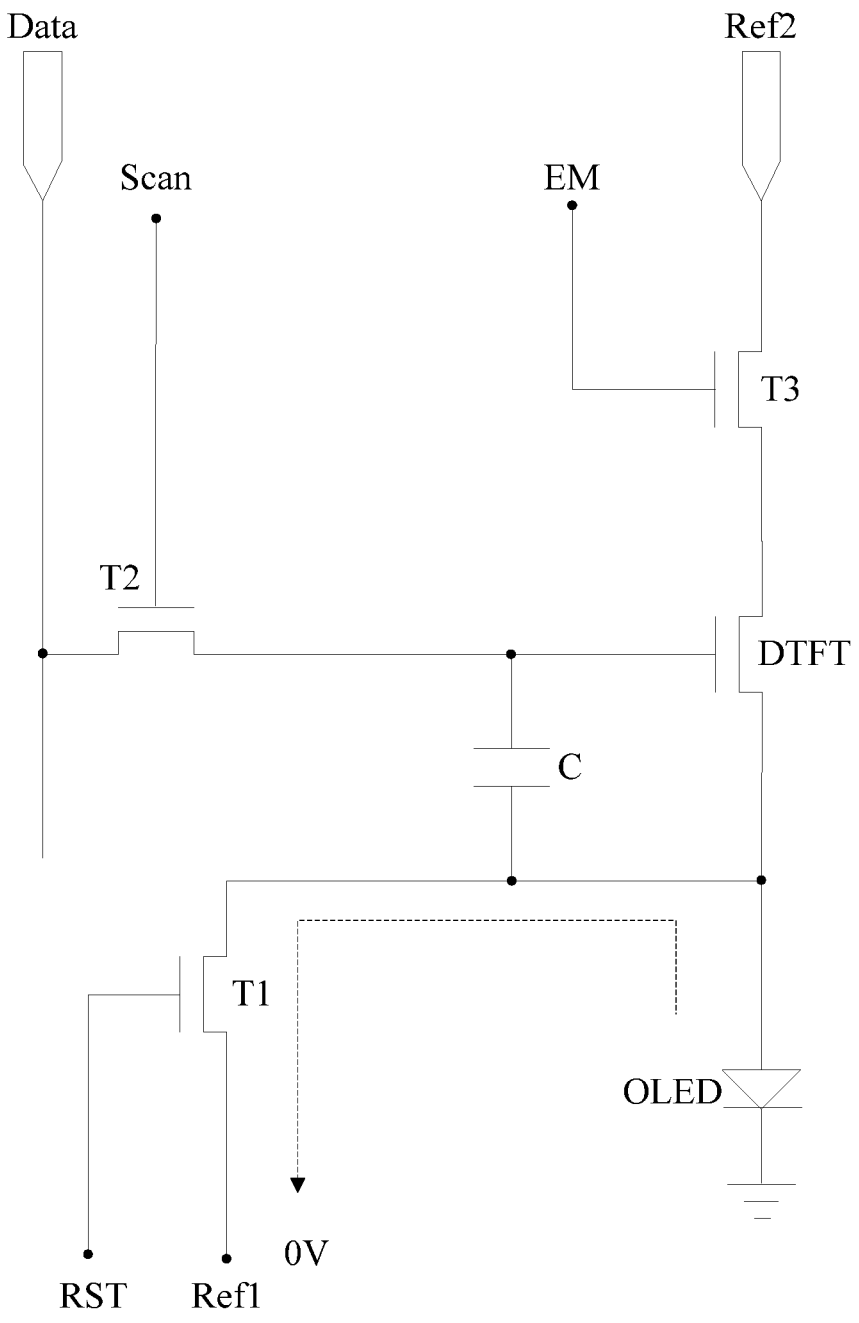
FIG. 6-FIG. 10 are schematic diagrams of the pixel circuit provided by the embodiment of the disclosure at a reset stage, a charging stage, a compensation stage and a light-emitting stage.

In the internal compensation mode, at a first stage, namely the reset stage, as shown in FIG. 6, the pixel circuit realizes a function of resetting the light-emitting device D1. At this stage, a low level signal is input to the scan signal terminal Scan and the light-emitting signal terminal EM, and the second switching transistor T2 and the third switching transistor T3 are turned off; a high level signal is input to the reset signal terminal RST, the first switching transistor T1 is turned on, the first level signal terminal Ref1 is connected with the light-emitting device D1 by the first switching transistor T1, namely, the potential of the light-emitting device D1 turns into 0.

Figure 7:
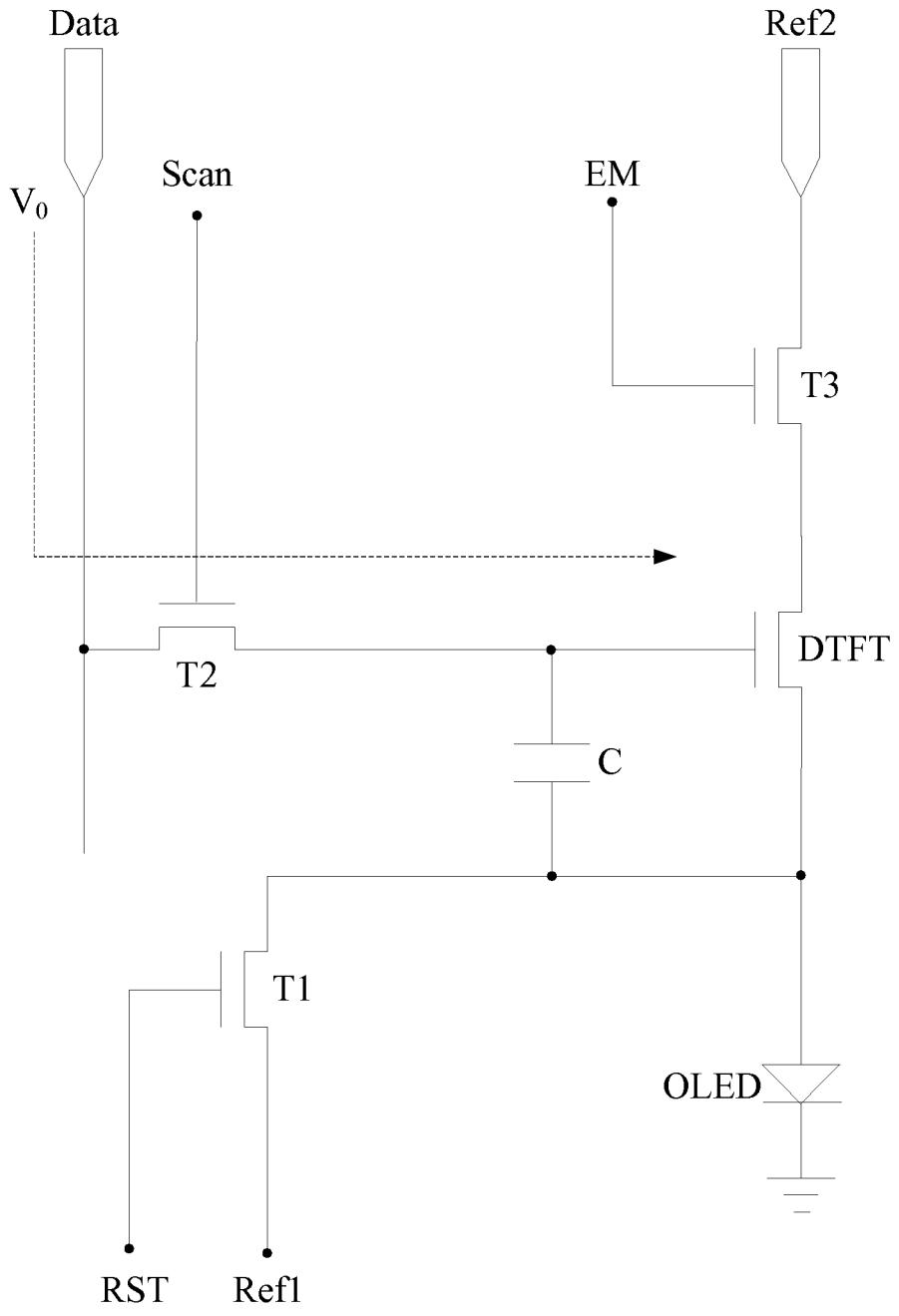
Figure 8:
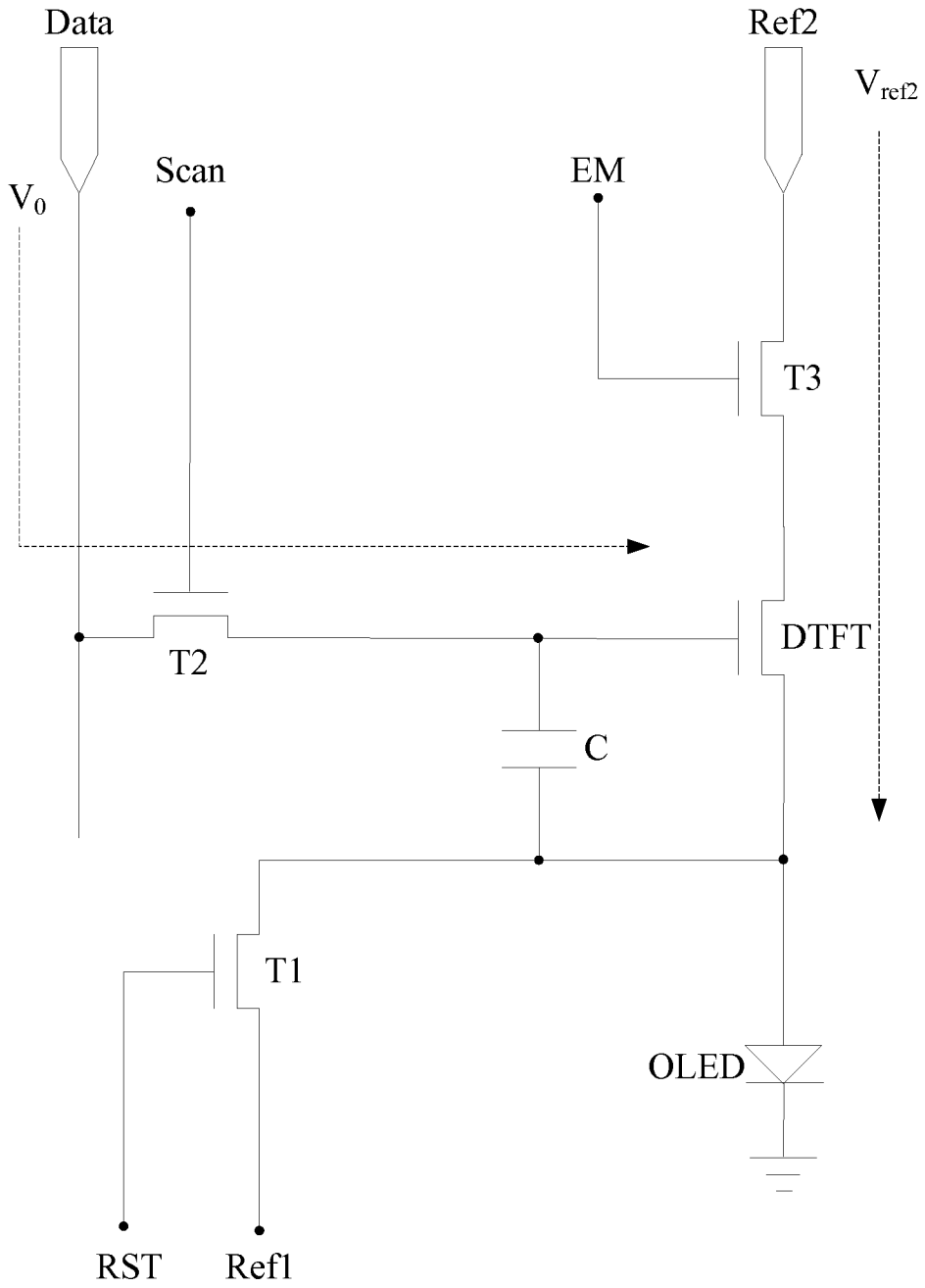

At a second stage, namely, the charging stage, as shown in FIG. 7 and FIG. 8, the pixel circuit realizes the function of applying voltage to the gate and drain of the driving transistor DTFT. At this stage, firstly, the voltage is applied to the gate of the driving transistor DTFT: as shown in FIG. 7, a low level signal is input to the reset signal terminal RST and the light-emitting signal terminal EM, and the first switching transistor T1 and the third switching transistor T3 are turned off; a high level signal is input to the scan signal terminal Scan, the second switching transistor T2 is turned on, and the data signal terminal Data is connected with the gate of the driving transistor DTFT by the second switching transistor T2 and writes a reference signal $V_0$ into the gate of the of the driving transistor DTFT; then, a voltage is applied to the drain of the driving transistor DTFT: as shown in FIG. 8, a low level signal is input to the reset signal terminal RST, and the first switching transistor T1 is turned off; a high level signal is input to the scan signal terminal Scan and the light-emitting signal terminal EM, the second switching transistor T2 and the third switching transistor T3 are turned on, the data signal terminal Data writes the reference signal $V_0$ into the gate of the driving transistor DTFT via the second switching transistor T2, the second level signal terminal Ref2 charges the drain of the driving transistor DTFT via the third switching transistor T3 till the potential of the drain of the driving transistor is $V_{ref2}-V_{th}$; in addition, as the reference signal $V_0$ written into the gate of the driving transistor DTFT is low, the driving transistor DTFT does not drive the light-emitting device D1 to emit light.

Figure 9:
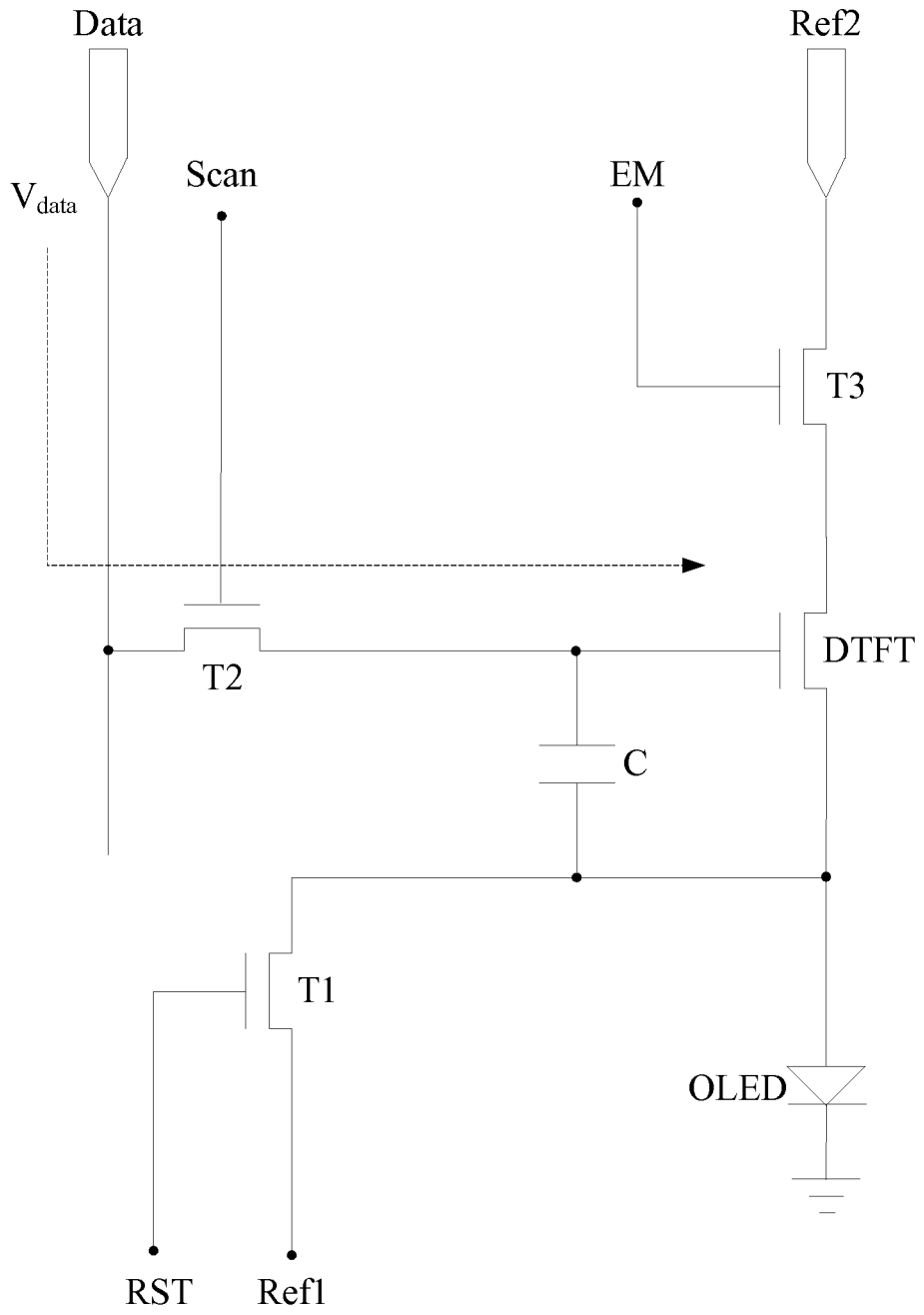

At a third stage, namely, the compensation stage, as shown in FIG. 9, the pixel circuit realizes the functions of compensating and transitioning the voltage of the drain of the driving transistor DTFT. At this stage, a low level signal is input to the reset signal terminal RST and the light-emitting signal terminal EM, and the first switching transistor T1 and the third switching transistor T3 are turned off; a high level signal is input to the scan signal terminal Scan, the second switching transistor T2 is turned on, the data signal terminal Data is connected with the gate of the DTFT via the second switching transistor T2, and a data signal $V_{data}$ is written into the gate of the driving transistor DTFT, the potential of the gate of the driving transistor DTFT changes from $V_0$ to $V_{data}$ accordingly, namely jumps to a potential same as that of the data signal terminal Data; and according to a capacitive power conservation principle, the potential of the drain of the driving transistor DTFT correspondingly jumps to $V_{ref2}-V_{th}+V_{data}-V_0$.

Figure 10:
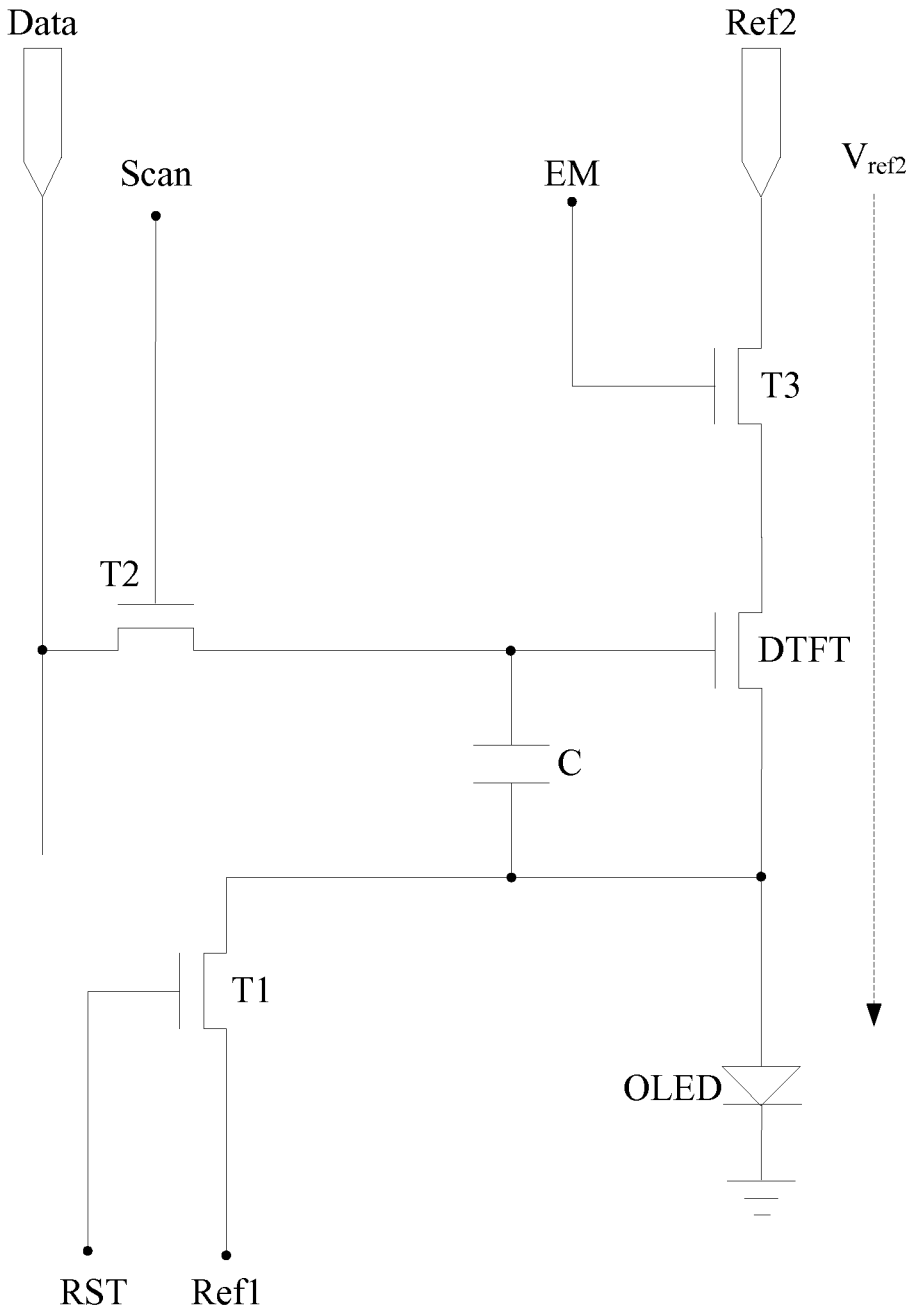

At a fourth stage, namely the light-emitting stage, as shown in FIG. 10, the pixel circuit realizes the function of driving the light-emitting device D1 to emit light by using the saturation current of the driving transistor DTFT. At this stage, a low level signal is input to the reset signal terminal RST and the scan signal terminal Scan, and the first switching transistor T1 and the second switching transistor T2 are turned off; a high level signal is input to the light-emitting signal terminal EM, the third switching transistor T3 is turned on, after a current signal of the second level signal terminal Ref2 flows to the driving transistor DTFT through the third switching transistor T3, the light-emitting device D1 is driven to emit light. It can be derived by a saturation current formula of the driving transistor DTFT that a working current flowing into the light-emitting device D1 is $$I_{OLED}=K(V_{gs}-V_{th})^2=k\alpha[V_{ref2}-(V_{ref2}-V_{th}+V_{data}-V_0)-V_{th}]^2=k\alpha(V_0-V_{data})^2$$

It can seen that the working current $I_{OLED}$ of the light-emitting device is not affected by the threshold Voltage $V_{th}$ of the driving transistor and is only related to the data signal voltage $V_{data}$ input from the data signal terminal and the reference signal voltage $V_0$, drift of the threshold voltage $V_{th}$ of the driving transistor caused by a technical process and device aging is thoroughly avoided, so as not to affect the working current $I_{OLED}$ of the light-emitting device D1, and ensure normal work of the light-emitting device D1.

In the external compensation mode, a high level signal is input to the reset signal terminal RST, the scan signal terminal Scan and the light-emitting signal terminal EM, the first switching transistor T1, the second switching transistor T2 and the third switching transistor T3 are turned on, and the data signal terminal Data is connected with the gate of the driving transistor DTFT via the second switching transistor T2, and writes the data signal $V_{data}$ into the gate of the driving transistor DTFT; the second level signal terminal Ref2 controls the driving transistor DTFT to drive the light-emitting device D1 to emit light through the third switching transistor T3; the first level signal terminal Ref1 is connected with the light-emitting device D1 by the first switching transistor T1, and exports a current signal of the driving transistor DTFT for driving the light-emitting device D1, and the exported current signal is compared with a preset standard current value to determine a compensation factor of the data signal.

Figure 11:
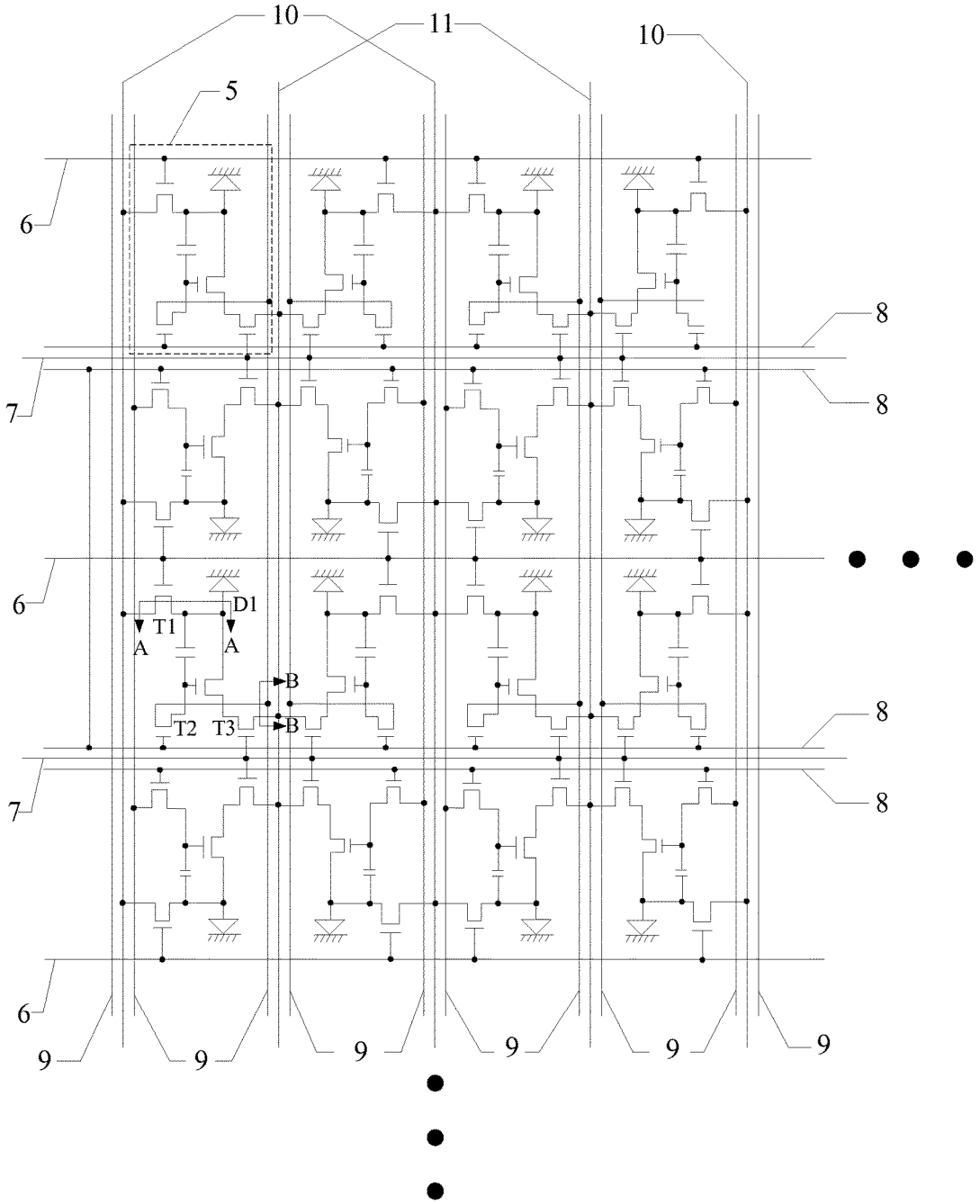
FIG. 11 is a structural schematic diagram of an organic electroluminescent display panel provided by an embodiment of the disclosure.

Based on a same concept, an embodiment of the disclosure further provides an organic electroluminescent display panel. FIG. 11 is a structural schematic diagram of an organic electroluminescent display panel provided by an embodiment of the disclosure. As shown in FIG. 11, the organic electroluminescent display panel comprises a plurality of pixel circuits 5 arranged in array, in FIG. 11, pixel circuits in four rows×four columns are taken as an example for description, and each pixel circuit 5 is the above pixel circuit provided by the embodiment of the disclosure. As a principle of the organic electroluminescent display panel for solving problems is similar to that of the above pixel circuit, implementation of the organic electroluminescent display panel can refer to the implementation of the pixel circuit, which is not described herein.

During implementation, the organic electroluminescent display panel provided by the embodiment of the disclosure, as shown in FIG. 11, further comprises: reset signal lines 6 and light-emitting signal lines 7 positioned in gaps among respective rows of the pixel circuits 5 at intervals, scan signal lines 8 positioned in gaps among respective rows of pixel circuits 5 having the light-emitting signal lines 7, and data signal lines 9 positioned in gaps among respective columns of pixel circuits 5.

Respective reset signal lines 6 are connected with reset signal terminals in adjacent rows of respective pixel circuits 5.

Respective light-emitting signal lines 7 are connected with light-emitting signal terminals in adjacent rows of respective pixel circuits 5.

Two scan signal lines 8 are arranged in the gaps where the respective light-emitting signal lines 7 are positioned, respectively. The two scan signal lines 8 are connected with the scan signal terminals in adjacent rows of respective pixel circuits 5, respectively. Two adjacent scan signal lines 8 respectively positioned in different gaps are electrically connected.

Two data signal lines 9 are arranged in gaps among respective columns of pixel circuits 5, respectively. The two data signal lines 9 are connected with the data signal terminals of odd-numbered or even-numbered rows of pixel circuits 5 in adjacent columns of respective pixel circuits 5, respectively. In the external compensation mode, a data signal is alternatively input to odd-numbered columns and even-numbered columns of data signal lines 9.

For example, as shown in FIG. 11, one reset signal line 6 is arranged in a gaps between the second row of pixel circuits 5 and the third row of pixel circuits 5, and the reset signal line 6 is connected with reset signal terminals in the second row of pixel circuits 5 and the third row of pixel circuits 5, namely, the second row of pixel circuits 5 and the third row of pixel circuits 5 share the reset signal line 6; one light-emitting signal line 7 and two scan signal lines 8 are arranged in gap between the first row of pixel circuits 5 and the second row of pixel circuits 5, the light-emitting signal line 7 is connected with the light-emitting signal terminals in the first row of pixel circuits 5 and the second row of pixel circuits 5, namely, the first row of pixel circuits 5 and the second row of pixel circuits 5 share the light-emitting signal line 7. The two scan signal lines 8 are connected with the scan signal terminals in the first row of pixel circuits 5 and the second row of pixel circuits 5, respectively. And, the two scan signal lines 8 respectively connected with the scan signal terminals in the second row of pixel circuits 5 and the third row of pixel circuits 5 are electrically connected.

In addition, as shown in FIG. 11, two data signal lines 9 are arranged in gap between the first column of pixel circuits 5 and the second column of pixel circuits 5. The two data signal lines 9 are connected with the data signal terminals of the odd-numbered rows (i.e., the first row and the third row) of pixel circuits 5 in the first column of pixel circuits 5 and the second column of pixel circuits 5, respectively. Two data signal lines 9 are arranged in gaps between the second column of pixel circuits 5 and the third column of pixel circuits 5 and are connected with the data signal terminals of the even-numbered rows (i.e., the second row and the fourth row) of pixel circuits 5 in the second column of pixel circuits 5 and the third column of pixel circuits 5, respectively.

During implementation, as shown in FIG. 11, when a low level signal is input to the two scan signal lines 8 connected with the scan signal terminals in the second row of pixel circuits 5 and the third row of pixel circuits 5, a low level signal is input to the reset signal lines 6 in gaps between the second row of pixel circuits 5 and the third row of pixel circuits 5, and a low level signal is input to the light-emitting signal lines 7 connected with light-emitting signal terminals in the second row of pixel circuits 5 and the third row of pixel circuits 5, the second row of pixel circuits 5 and the third row of pixel circuits 5 can be driven at the same time, thus a refresh rate of a display picture of the organic electroluminescent display panel can be improved.

During implementation, the organic electroluminescent display panel provided by the embodiment of the disclosure, as shown in FIG. 11, further comprises: first level signal lines 10 and second level signal lines 11 positioned in gaps among respective columns of pixel circuits 5.

The respective first level signal lines 10 are connected with the first level signal terminals in adjacent columns of respective pixel circuits 5;

The respective second level signal lines 11 are connected with the second level signal terminals in adjacent columns of respective pixel circuits 5.

For example, as shown in FIG. 11, a second level signal line 11 is arranged in gaps between the first column of pixel circuits 5 and the second column of pixel circuits 5, and is connected with second level signal terminals in the first column of pixel circuits 5 and the second column of pixel circuits 5, namely, the first column of pixel circuits 5 and the second column of pixel circuits 5 share the second level signal line 11; a first level signal line 10 is arranged in gaps between the second column of pixel circuits 5 and the third column of pixel circuits 5, and is connected with first level signal terminals in the second column of pixel circuits 5 and the third column of pixel circuits 5, namely, the second column of pixel circuits 5 and the third column of pixel circuits 5 share the first level signal line 10.

In the external compensation mode, as shown in FIG. 11, a case of performing external compensation on the odd-numbered columns of pixel circuits 5 in the second row of pixel circuits 5 is taken an example: a low level signal is input to the scan signal lines 8 connected with the scan signal terminals in the second row of pixel circuits 5, and a data signal is input to an even-numbered columns of data signal lines 9; a low level signal is input to the light-emitting signal lines 7 connected with the light-emitting signal terminals in the second row of pixel circuits 5, and the second level signal lines 11 connected with the second level signal terminals in the odd-numbered columns of pixel circuits 5 in the second row of pixel circuits 5 control the drive control module to drive the light-emitting device to emit light; a low level signal is input to the reset signal lines 6 connected with the reset signal terminals in the second row of pixel circuits 5, the first level signal lines 10 connected with the first level signal terminals in the odd-numbered columns of pixel circuits 5 in the second row of pixel circuits 5 export a current signal of the drive control module 1 for driving the light-emitting device, and the exported current signal is compared with a preset standard current value to determine a compensation factor of the data signals of the odd-numbered columns of pixel circuits 5 in the second row of pixel circuits 5.

A compensation factor of the data signals of the even-numbered columns of pixel circuits in the second row of pixel circuits is obtained in a way similar to that of obtaining the compensation factor of the data signals of the odd-numbered columns of pixel circuits in the second row of pixel circuits, which is not described herein. In addition, compensation factors of the data signals of respective columns of pixel circuits in other rows of pixel circuits is obtained in a way similar to that of obtaining the compensation factor of the data signals of respective columns of pixel circuits in the second row of pixel circuits, which is not described herein.

During implementation, in the organic electroluminescent display panel provided by the embodiment of the disclosure, in order to improve a refresh rate of a display picture of the organic electroluminescent display panel, two data signal lines are arranged in gaps among respective columns of pixel circuits, respectively, thus reducing an aperture ratio of the organic electroluminescent display panel. On this basis, in the organic electroluminescent display panel provided by the embodiment of the disclosure, in order to make up the influence of the added data signal lines on the aperture ratio of the display panel, the first level signal lines and the second level signal lines are arranged on a same layer, and are all arranged on a layer different from that of the data signal lines, namely, the first level signal lines, the second level signal lines and the data signal lines are arranged on two layers; thus, the first level signal lines and the second level signal lines as well as the data signal lines may have an overlapping region, such that wiring areas of the first level signal lines, the second level signal lines and the data signal lines are reduced, so as to increase the aperture ratio of the display panel.

During implementation, in the organic electroluminescent display panel provided by the embodiment of the disclosure, in order to increase the aperture ratio of the display panel, the first level signal lines and the second level signal lines as well as the data signal lines are arranged on two layers, and as compared with a structure where the first level signal lines, the second level signal lines and the data signal lines are arranged on a same layer, a masking process is added and a manufacturing cost of the display panel is increased. Accordingly, the first level signal lines, the second level signal lines and anodes of the light-emitting devices in the pixel circuits in the organic electroluminescent display panel provided by the embodiment of the disclosure can be formed at the same time with a halftone mask panel by a one-time patterning process, a film layer where the first level signal lines and the second level signal lines are formed is above a film layer of anodes of the light-emitting devices in the pixel circuits, so the aperture ratio of the display panel is ensured without increasing the times of the masking processes during manufacturing of the display panel.

Figure 12:
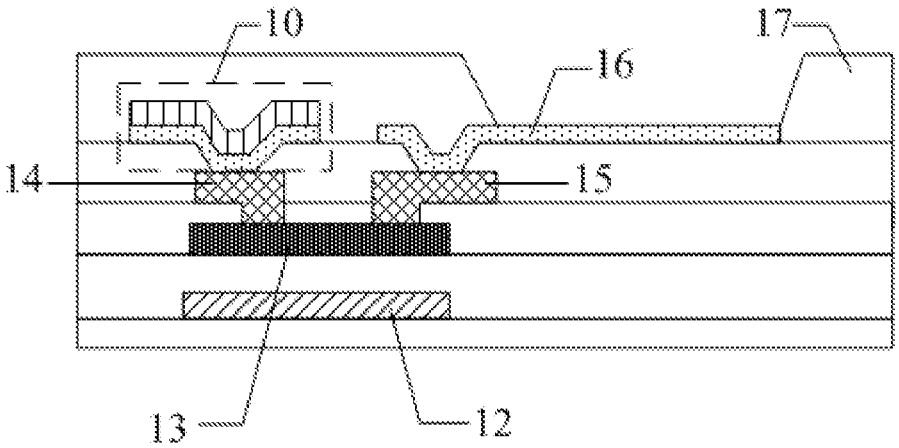
FIG. 12 is a side view of the organic electroluminescent display panel in FIG. 11 along an AA direction.

The forming the first level signal lines is taken as an example, FIG. 12 is a side view of the organic electroluminescent display panel in FIG. 11 along an AA direction. In FIG. 12, structures of a gate 12, an active layer 13, a source 14 and a drain 15 of the first switching transistor T1 are same as general structures, the first level signal line 10 is electrically connected with the source 14 of the first switching transistor T1 and formed at the same time when an anode 16 in the light-emitting device D1 is formed, and the anode 16 in the light-emitting device D1 is electrically connected with the drain 15 of the first switching transistor T1. A specific process of forming the first level signal line 10 and the anode 16 of the light-emitting device D1 is: firstly, forming a transparent conductive oxide film layer and a metal layer successively on an insulating layer above the source 14 and the drain 15 of the first switching transistor T1; and then performing a patterning process on the transparent conductive oxide film layer and the metal layer with a halftone mask pane; wherein, the metal layer and the transparent conductive oxide film layer reserved in a region corresponding to a totally lightproof region of the halftone mask panel serve as the first level signal line 10, the transparent conductive oxide film layer reserved in a region corresponding to a partially light transmitting region serves as the anode 16 of the light-emitting device D1, and the metal layer and the transparent conductive oxide film layer reserved in a region corresponding to a totally light transmitting region are completely etched.

In addition, during implementation, as shown in FIG. 12, an insulating layer 17 can be arranged above the first level signal line 10 and the anode 16 in the light-emitting device D1. The insulating layer 17 is subjected to a patterning process by using photoresist, the insulating layer 17 above the anode 16 in the light-emitting device D1 and in a binding region are etched, so as to expose the anode 16 in the light-emitting device D1 and the first level signal line 10 in the binding region.

Figure 13:
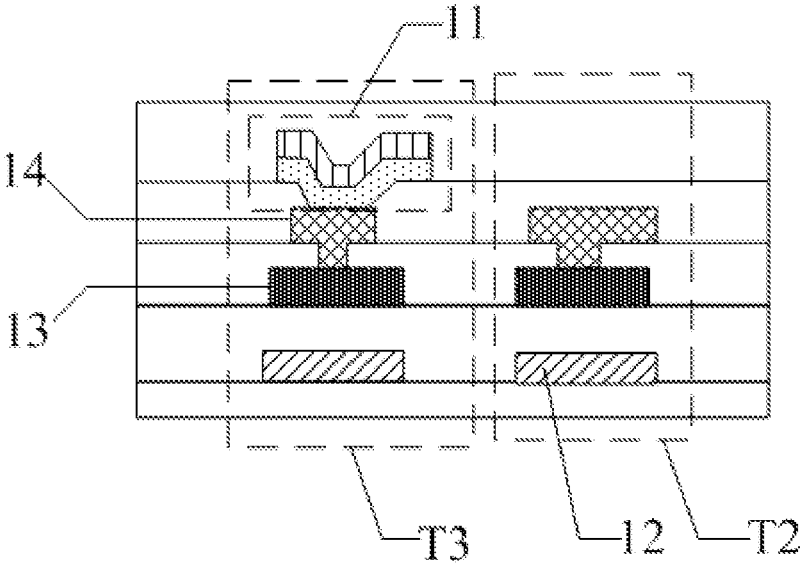
FIG. 13 is a side view of the organic electroluminescent display panel in FIG. 11 along a BB direction.

FIG. 13 is a side view of the organic electroluminescent display panel in FIG. 11 along a BB direction. In FIG. 13, the second level signal line 11 is electrically connected with a source 14 of the third switching transistor T3, the source 14 of the third switching transistor T3 is electrically connected with an active layer 13 of the third switching transistor T3; and a source 14 of the second switching transistor T2 is electrically connected with an active layer 13 of the second switching transistor T2.

Based on a same inventive concept, an embodiment of the disclosure further provides a display apparatus, comprising the organic electroluminescent display panel provided by the embodiment of the disclosure. The display apparatus may be a monitor, a cell phone, a television, a laptop, an all-in-one machine and the like. Other indispensable parts of the display apparatus are parts that should exist as understood by those of ordinary skill in the art, which is not described herein, and does not limit the disclosure.

The embodiments of the disclosure provide the pixel circuit, the organic electroluminescent display panel and the display apparatus. The pixel circuit comprises a light-emitting device, a drive control module, a reset control module, a charge control module and a light-emitting control module. The reset control module resets the light-emitting device in the internal compensation mode, and exports a current signal of the drive control module for driving the light-emitting device and compares the same with a preset standard current value to determine a compensation factor in the external compensation mode. The charge control module charges the drive control module and writes a data signal into the drive control module in the internal compensation mode and writes the data signal into the drive control module in the external compensation mode. The light-emitting control module charges the drive control module and controls the drive control module to drive the light-emitting device to emit light in the internal compensation mode, and controls the drive control module to drive the light-emitting device to emit light in the external compensation mode. Accordingly, the same pixel circuit can be shared for both internal compensation and external compensation.

Obviously, those skilled in the art can perform various changes and modifications on the disclosure without departing from the spirit and scope of the disclosure. Hence, if those changes and modifications of the disclosure fall into the scope of the claims of the disclosure and equivalents, the disclosure is also intended to contain such changes and modifications.

The application claims priority of Chinese Patent Application No. 201410403879.4 filed on Aug. 15, 2014, the disclosure of which is incorporated herein by reference in its entirety as part of the present application.

The invention claimed is:

1. A pixel circuit, comprising: a light-emitting device, a drive control module, a reset control module, a charge control module and a light-emitting control module, wherein, the reset control module has a control terminal connected with a reset signal terminal, an input terminal connected with a first level signal terminal, and an output terminal connected with an output terminal of the drive control module and an input terminal of the light-emitting device respectively; the reset control module is used for resetting the light-emitting device in an internal compensation mode, and exporting a current signal of the drive control module for driving the light-emitting device and comparing the same with a preset standard current value to determine a compensation factor in an external compensation mode;

the charge control module has a control terminal connected with a scan signal terminal, an input terminal connected with a data signal terminal, and an output terminal connected with a first input terminal of the drive control module; the charge control module is used for charging the drive control module and writing a data signal into the drive control module in the internal compensation mode, and writing the data signal into the drive control module in the external compensation mode;

the light-emitting control module has a control terminal connected with a light-emitting signal terminal, an input terminal connected with a second level signal terminal, and an output terminal connected with a second input terminal of the drive control module; the light-emitting control module is used for charging the drive control module and controlling the drive control module to drive the light-emitting device to emit light in the internal compensation mode, and controlling the drive control module to drive the light-emitting device to emit light in the external compensation mode;

an output terminal of the light-emitting device is grounded, wherein, in the Internal compensation mode, at a reset stage, the reset control module is in an ON state under control of the reset signal terminal, the first level signal terminal is connected with the light-emitting device, the first level signal terminal resets the light-emitting device; at a charging stage, the charge control module is in an ON state under control of the scan signal terminal, the data signal terminal is connected with the drive control module, the light-emitting control module is in an ON state under control of the light-emitting signal terminal, the second level signal terminal is connected with the drive control module, the data signal terminal and the second level signal terminal charge the drive control module; at a compensation stage, the data signal terminal writes a data signal into the drive control module under control of the scan signal terminal; at a light-emitting stage, under control of the light-emitting signal terminal, the second level signal terminal controls the drive control module to drive the light-emitting device to emit light.

2. The pixel circuit according to claim 1, wherein, in the external compensation mode, under control of the scan signal terminal, the data signal terminal writes a data signal into the drive control module; under control of the light-emitting signal terminal, the second level signal terminal controls the drive control module to drive the light-emitting device to emit light; under control of the reset signal terminal, the first level signal terminal exports a current signal of the drive control module for driving the light-emitting device, and the exported current signal is compared with a preset standard current value to determine a compensation factor of the data signal.

3. The pixel circuit according to claim 1, wherein, in the external compensation mode, under control of the scan signal terminal, the data signal terminal writes a data signal into the drive control module; under control of the light-emitting signal terminal, the second level signal terminal controls the drive control module to drive the light-emitting device to emit light; under control of the reset signal terminal, the first level signal terminal exports a current signal of the drive control module for driving the light-emitting device, and the exported current signal is compared with a preset standard current value to determine a compensation factor of the data signal.

4. The pixel circuit according to claim 1, wherein, the drive control module includes a driving transistor and a capacitor, wherein, a gate of the driving transistor is connected with the charge control module, a source of the driving transistor is connected with the light-emitting control module, and a drain of the driving transistor is connected with the light-emitting device and the reset control module, respectively;

the capacitor is connected between the gate and the drain of the driving transistor.

5. The pixel circuit according to claim 1, wherein, the drive control module includes a driving transistor and a capacitor, wherein, a gate of the driving transistor is connected with the charge control module, a source of the driving transistor is connected with the light-emitting control module, and a drain of the driving transistor is connected with the light-emitting device and the reset control module, respectively;

the capacitor is connected between the gate and the drain of the driving transistor.

6. The pixel circuit according to claim 2, wherein, the drive control module includes a driving transistor and a capacitor, wherein, a gate of the driving transistor is connected with the charge control module, a source of the driving transistor is connected with the light-emitting control module, and a drain of the driving transistor is connected with the light-emitting device and the reset control module, respectively;

the capacitor is connected between the gate and the drain of the driving transistor.

7. The pixel circuit according to claim 3, wherein, the drive control module includes a driving transistor and a capacitor, wherein, a gate of the driving transistor is connected with the charge control module, a source of the driving transistor is connected with the light-emitting control module, and a drain of the driving transistor is connected with the light-emitting device and the reset control module, respectively;

the capacitor is connected between the gate and the drain of the driving transistor.

8. The pixel circuit according to claim 4, wherein, the reset control module includes a first switching transistor, wherein a gate of the first switching transistor is connected with the reset signal terminal, a source of the first switching transistor is connected with the first level signal terminal, and a drain of the first switching transistor is connected with the drain of the driving transistor and the light-emitting device.

9. The pixel circuit according to claim 5, wherein, the reset control module includes a first switching transistor, wherein a gate of the first switching transistor is connected with the reset signal terminal, a source of the first switching transistor is connected with the first level signal terminal, and a drain of the first switching transistor is connected with the drain of the driving transistor and the light-emitting device.

10. The pixel circuit according to claim 4, wherein, the charge control module includes a second switching transistor, wherein, a gate of the second switching transistor is connected with the scan signal terminal, a source of the second switching transistor is connected with the data signal terminal, and a drain of the second switching transistor is connected with the gate of the driving transistor.

11. The pixel circuit according to claim 5, wherein, the charge control module includes a second switching transistor, wherein, a gate of the second switching transistor is connected with the scan signal terminal, a source of the second switching transistor is connected with the data signal terminal, and a drain of the second switching transistor is connected with the gate of the driving transistor.

12. The pixel circuit according to claim 4, wherein, the light-emitting control module includes a third switching transistor; wherein a gate of the third switching transistor is connected with the light-emitting signal terminal, a source of the third switching transistor is connected with the second level signal terminal, and a drain of the third switching transistor is connected with the source of the driving transistor.

13. The pixel circuit according to claim 5, wherein, the light-emitting control module includes a third switching transistor; wherein a gate of the third switching transistor is connected with the light-emitting signal terminal, a source of the third switching transistor is connected with the second level signal terminal, and a drain of the third switching transistor is connected with the source of the driving transistor.

14. An organic electroluminescent display panel, comprising a plurality of pixel circuits arranged in array, the pixel circuits being the pixel circuit according to claim 1.

15. The organic electroluminescent display panel according to claim 14, further comprising: reset signal lines and light-emitting signal lines positioned in gaps among respective rows of the pixel circuits at intervals, scan signal lines positioned in gaps among respective rows of pixel circuits having the light-emitting signal lines, and data signal lines positioned in gaps among respective columns of pixel circuits; wherein, respective reset signal lines are connected with reset signal terminals in adjacent rows of respective pixel circuits;

respective light-emitting signal lines are connected with light-emitting signal terminals in adjacent rows of respective pixel circuits;

two scan signal lines are arranged in the gaps where the respective light-emitting signal lines are positioned respectively; the two scan signal lines are connected with the scan signal terminals in adjacent rows of respective pixel circuits respectively; and two adjacent scan signal lines positioned in different gaps respectively are electrically connected;

two data signal lines are arranged in gaps among respective columns of pixel circuits respectively; the two data signal lines are connected with the data signal terminals of odd-numbered or even-numbered rows of pixel circuits in adjacent columns of respective pixel circuits; in the external compensation mode, a data signal is alternatively input to odd-numbered columns and even-numbered columns of data signal lines.

16. The organic electroluminescent display panel according to claim 15, further comprising: first level signal lines and second level signal lines positioned in gaps among respective columns of pixel circuits at intervals; wherein, the respective first level signal lines are connected with the first level signal terminals in adjacent columns of respective pixel circuits;

the respective second level signal lines are connected with the second level signal terminals in adjacent columns of respective pixel circuits.

17. The organic electroluminescent display panel according to claim 16, wherein, the first level signal lines and the second level signal lines are arranged on a same layer, and are all arranged on a layer different from that of the data signal lines.

18. The organic electroluminescent display panel according to claim 17, wherein, a film layer where the first level signal lines and the second level signal lines are positioned is above a film layer where anodes of the light-emitting devices in the pixel circuits are positioned.

19. A display apparatus comprising the organic electroluminescent display panel according to claim 7.

* * * * *